United States Patent [19]

Guthmann

[11] 4,190,011

[45] * Feb. 26, 1980

[54] BOAT MOORING APPARATUS

[76] Inventor: Stephen F. Guthmann, 1 Brandon Rd., Onondaga County, N.Y. 13214

[ * ] Notice: The portion of the term of this patent subsequent to Aug. 29, 1995, has been disclaimed.

[21] Appl. No.: 912,725

[22] Filed: Jun. 5, 1978

Related U.S. Application Data

[63] Continuation-in-part of Ser. No. 734,290, Oct. 20, 1976, Pat. No. 4,109,603.

[51] Int. Cl.[2] ..... B63B 21/00

[52] U.S. Cl. ..... 114/230; 114/218

[58] Field of Search ..... 114/218, 230; 24/115 R, 24/115 H, 115 J, 128 R, 129 A, 129 D, 130, 119, 136 R, 136 L, 136 K

[56] References Cited

U.S. PATENT DOCUMENTS

| | | | |
|---|---|---|---|
| 2,229,471 | 1/1941 | Powers | 24/128 R |
| 3,083,676 | 4/1963 | Andersen | 114/230 |
| 4,109,603 | 8/1978 | Guthmann | 114/230 |

*Primary Examiner*—Jesus D. Sotelo

[57] ABSTRACT

A boat mooring apparatus comprising two main units, namely, a boat mooring line apparatus and a boat mooring cleat apparatus, used to releasably secure a boat to a mooring post.

The boat mooring line apparatus constitutes a mooring line of a given diameter with several bulges spaced therealong, the bulges having a diameter greater than that of the mooring line, with the distal end of the line comprising a slip-loop. The cleat apparatus includes two substantially parallel spaced apart members which between them define a slot that is as wide as the diameter of the mooring line, but narrower than the diameter of any bulge on the line. The parallel spaced members are transversely registered at one end where they are affixed to a mounting plate for securement to a boat. One member is inverted U-shaped so that it rises from the boat, thereafter extends along and spaced from the boat, and then extends back to the boat. Because the slot is narrower than any one of the bulges, the facing edges of the spaced apart members define a stop for at least one of the bulges to prevent removal of the mooring line proximal end from the cleat by a tensile force along the line. However, the mooring line can be deliberately removed from the cleat by applying a force normal to the line in a direction away from the transversely registered ends.

30 Claims, 21 Drawing Figures

BOAT MOORING APPARATUS

CROSS-REFERENCE TO RELATED APPLICATION

This application is a continuation-in-part of co-pending application Ser. No. 734,290 filed Oct. 20, 1976 for BOAT MOORING APPARATUS Pat. No. 4,109,603 is derived from co-pending application Ser. No. 734,290. An essential difference between this patent and my U.S. Pat. No. 4,109,603 is in the parallel members. While the cleats in U.S. Pat. No. 4,109,603 have two inverted U-shaped members, here there is only one. Simply stated, the inverted U-shaped member is the one which is connected at both ends.

BACKGROUND OF THE INVENTION

1. Field of the Invention

The present invention relates to boat mooring devices and particularly to such devices for enabling quick releasable mooring of a boat.

2. Description of the Prior Art

Means for mooring boats have existed ever since man realized the ability to use boats, and desired to use a particular boat more than once. One of the most basic boat mooring devices is a cleat on a boat which functions in conjunction with a mooring line such as one having a fixed loop at the distal end thereof which is thrown about the mooring post with the proximal end of the rope removably secured to the cleat by wrapping the rope around the cleat in a predetermined and well-accepted configuration. If done properly, such an arrangement readily succeeds in securely mooring the boat. However, with the advent of the "weekend sailor", a desire for quicker and more easily manageable mooring devices has developed.

Examples of such typical prior art mooring devices are disclosed in U.S. Pat. Nos. 750,141; 2,403,057; 2,666,934; 2,912,953; 3,094,755; 3,101,695; 3,224,404; 3,473,505; 3,507,243. These prior art boat mooring devices, with the exception of the cleats shown in my co-pending application aforesaid, while simplifying various aspects of the mooring operation such as by the use of a slip-loop device at the distal end of the mooring line, have not sufficiently simplified the complete mooring assembly so as satisfactorily to enable quick releasable mooring of a boat to a mooring post by employing both a slip-loop mooring line and a quick-release and quick-securement cleat. These disadvantages of the prior art are overcome by the present invention.

SUMMARY OF THE INVENTION

A boat mooring apparatus for enabling quick releasable mooring of a boat to a mooring post means is provided in which the apparatus comprises a mooring line means having a n associated diameter and a plurality of longitudinally spaced apart bulges therealong such as knots in the line. The bulges need not be knots but may be almost any structures which enlarge the diameter of the mooring line means at selected places. The bulges have transverse dimensions greater than the mooring line means diameter.

Means is operatively associated with the mooring line means for forming an adjustable size slip-loop at the distal end of the mooring line means, with the slip-loop so formed being slippable over the mooring post means and adjustably tightenable thereabout to securely fasten the mooring line means to the mooring post means.

A boat mountable cleat means is provided which comprises a pair of substantially parallel spaced apart members defining a slot for insertably receiving a portion of the proximal end of the mooring line means opposite from the distal end thereof in which predetermined slippage of the inserted mooring line means is permitted. A single one of the parallel members forms an inverted U-shaped member with the boat surface.

The members are transversely registered at one end thereof and are there affixed to a mounting means that is secured to the boat.

The cleat means further may include two parallel extensions at the ends opposite from the transversely registered ends which project essentially rearwardly of the inverted U-shaped member to require an additional directional movement for removal of the mooring line means proximal end portion.

The cleat also may comprise a removable pin means which is removably insertable behind the inserted bulge for preventing accidental withdrawal of the inserted mooring line means proximal end portion from the slot.

Regardless of slot shape, the slot is narrower in width than the transverse dimensions of every bulge and the spaced apart members define a stop member for an adjacent one of the bulges of the inserted mooring line means proximal end portion for preventing removal of the inserted mooring line means proximal end portion from the cleat means by a tension force along the mooring line means while enabling quick intentional removal of the inserted mooring line means proximal end portion from the cleat means slot by a sufficient force substantially normal to the mooring line means. Preferably, the slot is only slightly greater in width than the mooring line means diameter, thus providing a snug fit.

In addition, the mooring line means may include a supplemental resilient means such as a spring, or elastic, e.g. one connected prior to the location of the bulges or knots for expediting the quick insertion of the mooring line means proximal end portion in the slot while providing an additional bearing force for the adjacent bulge of the inserted mooring line means proximal end portion against the stop member in response to the mooring line means being pulled taut.

BRIEF DESCRIPTION OF THE DRAWINGS

FIG. 3 is a perspective view of one embodiment of the cleat portion of the boat mooring apparatus of FIG. 1; it shows arcuate members and shows an opening in the slot large enough for a bulge to pass through;

DETAILED DESCRIPTION OF THE PREFERRED EMBODIMENTS

Figure 1:
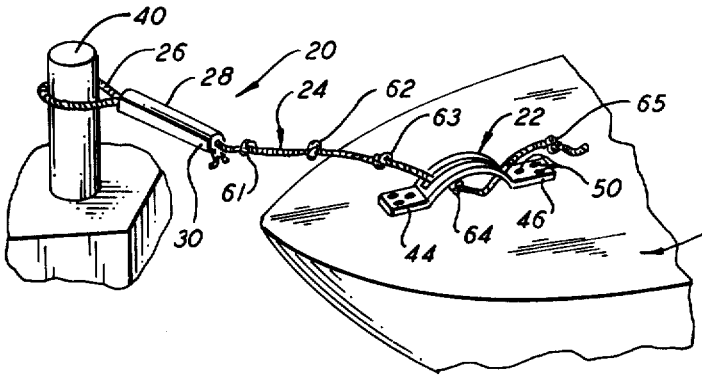
FIG. 1 is a fragmentary diagrammatic illustration of the preferred use of the boat mooring apparatus of the present invention.
Figure 2:
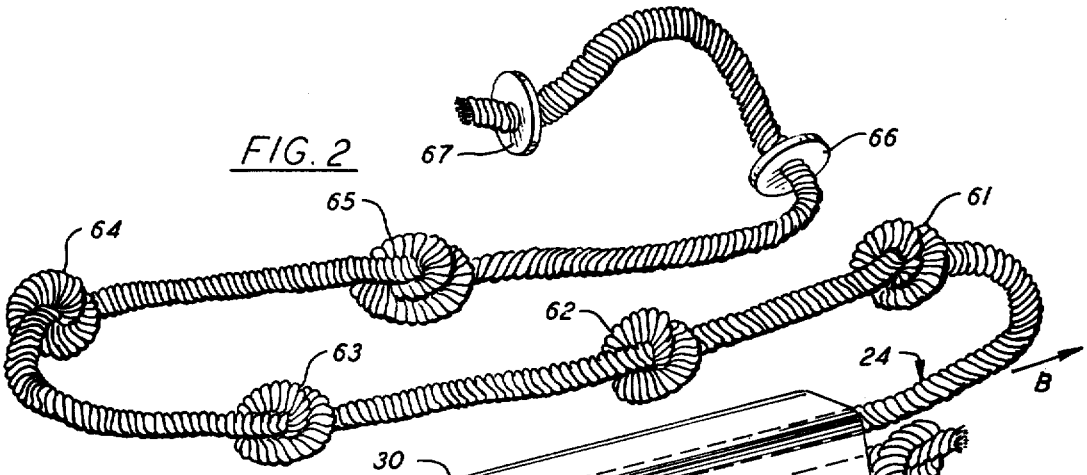
FIG. 2 is a perspective view of a mooring line means of the boat mooring apparatus of FIG. 1, but additionally showing bulges other than knots, e.g. discs, carried by the mooring line means proximal end portion.
Figure 21:
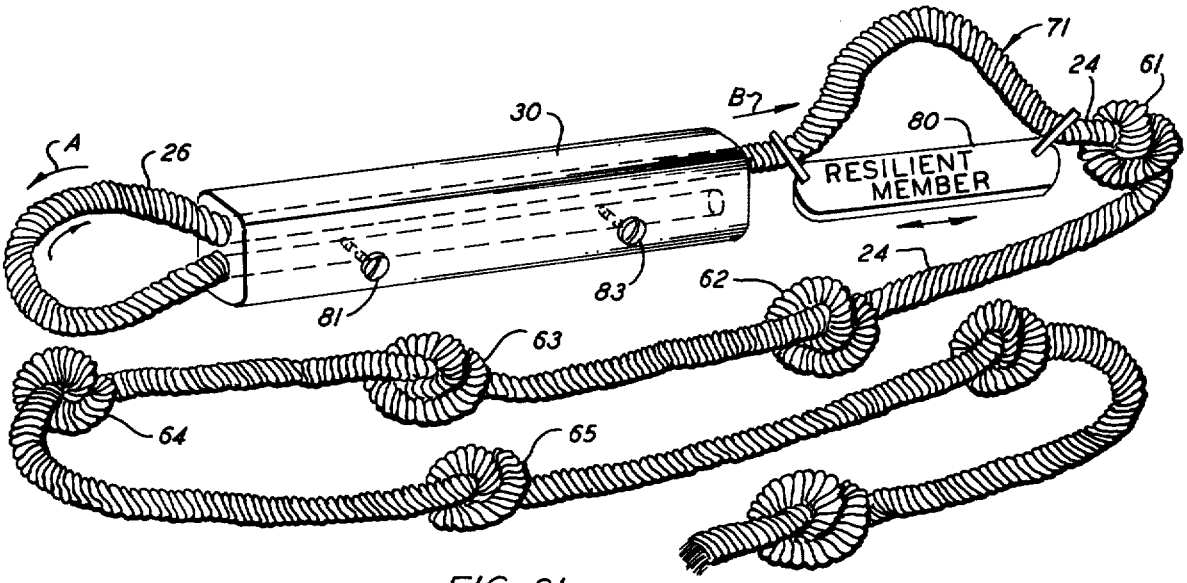
FIG. 21 is a perspective view of an alternative embodiment of the mooring line means and slip-loop portions, similar to FIG. 2, and showing, in addition, a resilient member positioned between the slip-loop end and the bulge end.

Referring now in detail to the drawings, and initially to FIGS. 1-4, the preferred boat mooring apparatus, generally referred to by the reference numeral 20, of the present invention will be described. As shown in FIG. 1, the boat mooring apparatus 20 of the present invention includes a cleat 22, a mooring line 24 having a slip-loop 26 at the distal end thereof, and a means 28 for forming the slip-loop 26 at said distal end. Said means 28, as shown in FIG. 2, may comprise an elongated member 30 having a pair of parallel longitudinal open-ended channels or bores 32 and 34 running therethrough. Preferably, the diameter of the channel 32 is somewhat greater than the diameter of the mooring line 24 passing therethrough whereby to enable the mooring line 24 to slidably pass through channel 32 so as to vary the size of the slip-loop 26 formed by such slidable passage of mooring line 24 through channel 32, which line 24 is fastened at the other end in channel 34. Although the mooring line 24 is shown in FIG. 2 as passing through channel 34 and being secured at the end opposite from the slip-loop 26 by means of a bulge or knot 36 so as to prevent the mooring line from being drawn back through channel 34, it is of course understood that any other manner of securement of the end of the mooring line such as by screwing or gluing the mooring line within member 30, such as illustrated in FIG. 21 by screws 81,83, may be accomplished so long as the mooring line 24 is fixed at one end to enable the formation of slip-loop 26 by sliding movement of mooring line 24 through channel 32 of member 30 in conventional fashion. Thus, slip-loop 26 will enable the mooring line 24 to be slipped over a mooring post 40 and adjustably tightened thereabout to bring member 30 to bear against mooring post 40 in tight relationship and prevent the slip-loop 26 from inadvertently sliding back over the top of the post 40. Moreover, this tightening effect is enhanced by the normal movements of the moored boat away from the dock. When it is desired to remove the mooring line 24 from mooring post 40, the slip-loop 26 merely is loosened by pulling member 30 away from post 40 thereby pulling mooring line 24 through channel 32 so as to enlarge the slip-loop 26 to a diameter greater than the diameter of the mooring post 40, whereupon the slip-loop 26 then merely is lifted back up over the top of mooring post 40.

Figure 3:
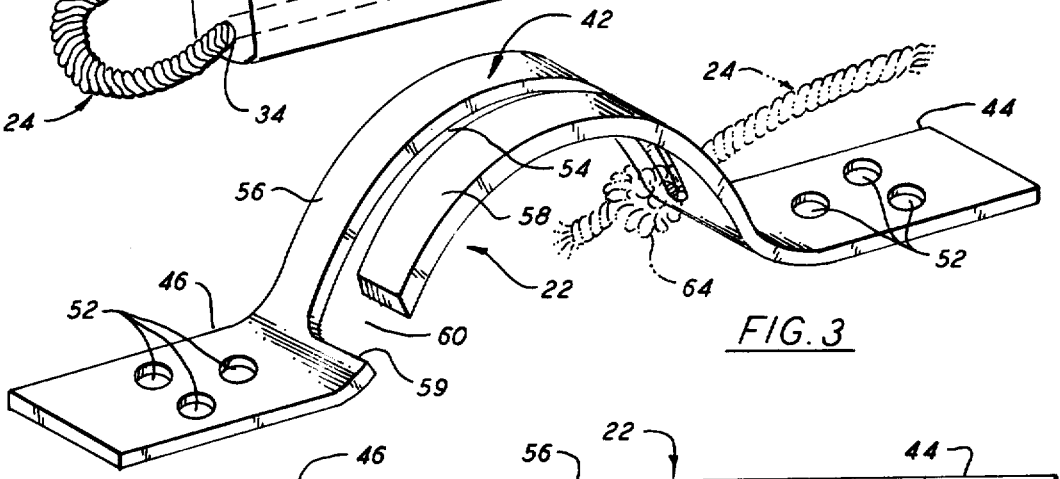
Figure 4:
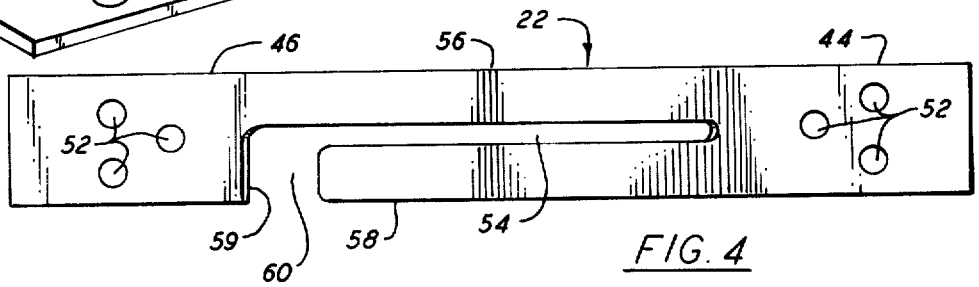
FIG. 4 is a plan view of the cleat illustrated in FIG. 3.

With respect to that embodiment of the cleat portion 22 of the boat mooring apparatus 20 shown in FIG. 1, such portion 22 is shown in greater detail in FIGS. 3 and 4. As shown in FIG. 3, cleat 22 comprises an arcuate portion 42 which terminates in planar portions 44 and 46 at the opposite ends thereof, the arcuate portion 42 being of semicircular configuration. The planar portions 44 and 46 are provided for securely mounting the cleat 22 on the deck 48 of a boat, such as by conventional screws 50 or other fasteners. In order to accomplish this, apertures 52 are provided in the mounting portions 44 and 46, with three such apertures being shown, by way of example, in each mounting portion 44 and 46. The arcuate portion 42 has an arcuate channel or slot 54 disposed centrally and longitudinally therein, the arcuate slot 54 being defined by spaced apart segments 56 and 58 of the arcuate portion 42 of the cleat 22. As further shown in FIG. 3, this arcuate slot 54 and the segment 58 terminate near but spaced upwardly from one planar portion, in this illustration, planar portion 46. The planar portion 46 and the segment 58 thus define an enlarged access opening 60 to the slot 54. The cleat 22 is so mounted on the boat deck that the enlarged access opening 60 is located at the end of the cleat normally furthest from the mooring post means 40. The segment 56 extends between the two flat mounting portions 44, 46.

All edges of the cleat that may contact the mooring line are smooth and rounded to prevent chafing of the line.

The mooring line 24 contains a plurality of bulges such as knots or disc-like projections longitudinally spaced therealong, with five such knots 61, 62, 63, 64 and 65 being shown by way of example in FIG. 1.

These knots 61-65 preferably are spaced at predetermined distances along the mooring line 24 so as to allow for quick releasable securement of the mooring line 24 to the cleat 22 at variable predetermined distances from the mooring post 40 dependent on the desired amount of slack to remain in mooring line 24 when the boat is moored. The associated diameters of the various bulges or knots 61–65 preferably are equal, and greater in diameter than the associated diameter of the mooring line 24. Furthermore, the width of the slot 54 preferably is substantially equal to the diameter of the mooring line in order essentially to require a snug fit of the mooring line through the slot 54, and the length and width of the enlarged access opening 60 preferably are greater than the diameter of any one of the bulges or knots 61–65 so as to enable the passage or entry of the desired knot or bulge 61–65 through the access opening 60 when securing or attaching the mooring line 24 to the cleat 22 in order to complete the boat mooring operation, as will be described in greater detail hereinafter.

In lieu of or in addition to the knots 61–65, the spaced bulges may be provided by discs 66, 67 (see FIG. 2) which are secured to the line 24 and function in the same manner as the knots.

The most economical mooring is a rope. However, any limp elongated member can be used, e.g. a chain or a metal cable.

Because the length and width of the enlarged access opening 60 is greater than the diameter of an associated bulge 61–65, this enlarged portion 60 may be located at a point spaced upwardly along the arc of segment 56 so as to help prevent accidental withdrawal or exit of a knot 61–65 through the enlarged opening 60 by a force along the mooring line 24. Thus, the surface 59 of planar portion 46 acts as a bumper to help prevent a bulge from accidentally coming out of the cleat at a time, for example, when the inserted bulge may be loosely lying on the boat deck.

Now describing the operation of the boat mooring apparatus 20 of the present invention, the user initially ensures that the slip-loop 26 is of sufficient size to readily slip over the mooring post 40. This is accomplished by sliding the mooring line 24 through channel 32 in the direction of arrow A (FIG. 2) until the slip-loop 26 so formed is of the desired size. Thereafter, when the boat to be moored is sufficiently close to the dock and/or mooring post 40, the user tosses or slips the slip-loop over the top of the mooring post 40 and thereafter pulls on the mooring line 24 in the opposite direction to arrow A, as indicated by arrow B (FIG. 2), thereby pulling mooring line 24 back through channel 32 so as to tighten the slip-loop about the mooring post 40 to the desired tightness such as to cause member 30 substantially to bear against the mooring post 40. Thereafter, depending on the desired slack of the line 24 and the proximity of the boat to be moored to the mooring post 40, the user inserts the knot or bulge corresponding to this desired slack of mooring line 24, for example, knot 64 in FIG. 1, through the enlarged access opening 60 in slot 54 with the mooring line being urged in a downward direction to ensure that the line 24 adjacent the desired bulge or knot 64 is also passed through the slot 54. Thereafter, due to normal movement of the boat being moored, the knot or bulge 64 moves forward toward the mounting portion 44 to bear against the inside portions of segments 56 and 58 which define slot 54. These inside portions comprise a stop member for knot or bulge 64 since the diameter of the knot 64 is greater than the width of the slot 54. In this regard, it should be noted that the spacing between adjacent knots, discs of bulges 61–62, 62–63, 63–64 and 64–65, 65–66, 66–67 by way of example, may be equal to the longitudinal length of the slot 54 so as to enable ready passage of the selected knot or bulge, 64 by way of example, through the enlarged access opening 60 of the slot 54, although such need not be the case.

As previously mentioned, enlarged access opening 60 is disposed along the arc of slot 54 upwardly from the horizontal so as to prevent accidental withdrawal of the knot 64 through the enlarged opening 60 if the boat being moored should move forward a sufficient distance to accidentally enable such withdrawal or exit of knot 64 when mooring line 24 is substantially horizontal. Thus, the boat may quickly be moored by tossing the slip-loop over the mooring post 40, which slip-loop may be tightened down merely by pulling on mooring line 24 in the direction of arrow B followed by the subsequent quick insertion of the mooring line 24 in slot 54 of cleat 22 by a downward thrust substantially normal to the mooring line 24 so as to quickly pass the desired knot or bulge 64 through the enlarged opening 60. The boat then is moored via this line 24 without the necessity of tying up the line 24 about a conventional cleat.

In order to remove the mooring line 24, the opposite procedure occurs, such as by loosening the slip-loop 26 by pulling member 30 away from post 40, thereby pulling mooring line 24 in the direction of arrow A, thereafter lifting slip-loop 26 over and away from mooring post 40, and subsequently pulling mooring line 24 in the upward direction substantially normal to mooring line 24 so as to forceably exit knot or bulge 64 back through enlarged opening 60. Thus, by this arrangement, accidental removal of the inserted mooring line 24 from the cleat 22 by a force along the mooring line 24 is prevented while both quick insertion of the mooring line 24 and quick intentional removal of the inserted mooring line 24 from the slot 54 of the cleat 22 is enabled by application of a sufficient force substantially normal to the mooring line 24.

As shown in FIGS. 13, 14, 15 and 16, if desired, added safety means may be provided to prevent accidental withdrawal or exit of the inserted knot 64. By way of example, such means constitutes an L-shaped pin 70 which is removably insertable in a passageway 72 which intersects the slot 54 above the enlarged access opening 60. When the knot 64 has been inserted through enlarged access opening 60, the pin 70 is inserted in passageway 72 behind the knot 64 to prevent accidental withdrawal of the mooring line 24. Any of the cleats heretofore and hereafter described may have a similar removable pin. The passageway 72 is so oriented that the pin is held in place by the force of gravity.

As shown in FIG. 21, the mooring apparatus 20 may be further enhanced by employing a resilient member 80, such as an elastic band formed of an elastomer, or a spring, located prior to the bulges or knots 61, 62, 63, 64, 65, with line 24 having an arcuate bow 71 therein which is longitudinally spanned by resilient member 80. The longitudinal extent of the resilient member 80 is preferably sufficiently less than the arcuate extent of the mooring line 24 at bow 71 so as to enable resilient member 80 to return the bow 71 to its rest position or arcuate shape after member 80 has been longitudinally stretched. In this manner, prior to insertion of the mooring line 24 in the slot 54 in the cleat 22, the line 24 which has been mounted at one end to mooring post 40 may be pulled so as to stretch the resilient member 80 which is preferably held in this stretched or expanded condition as the selected knot or bulge, for example knot 64, is inserted through the enlarged portion 60. Thereafter, when the mooring line is released by the user, the resilient contraction of member 80 quickly will force the knot 64 into bearing relationship against the stop member formed by the inside portion of segments 56 and 58 defining slot 54. In addition, as the boat which is moored sways or moves with the tide, the expansion and contraction of resilient member 80 will provide an additional bearing force for the adjacent knot 64 of the inserted mooring line 24 against the aforementioned stop member in response to the mooring line 24 being pulled taut.

Figure 5:
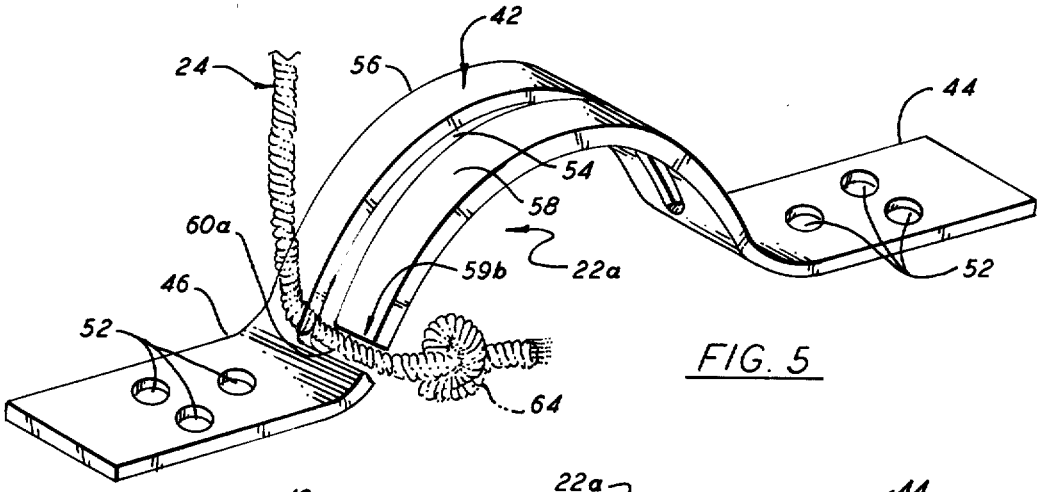
FIG. 5 is a perspective view of still another embodiment of the cleat portion of the boat mooring apparatus in FIG. 1; it shows an opening in the slot which is slightly larger than the mooring line means diameter but smaller than the diameter of a bulge.
Figure 6:
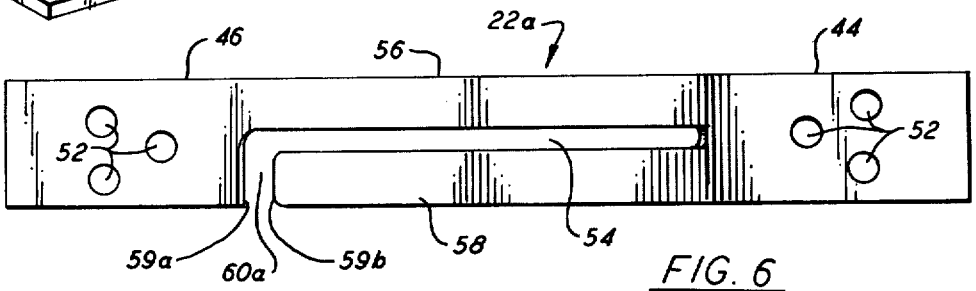
FIG. 6 is a plan view of the cleat illustrated in FIG. 5.

Referring now to FIGS. 5 and 6, an alternative embodiment of the cleat 22 of the present invention is shown, this embodiment being given reference numeral **22*a*. Its purpose also is to hold a boat securely moored. It differs from cleat 22 in the size of the access opening 60*a* of cleat 22*a* vis-a-vis access opening 60 of cleat 22. Access opening 60*a* is defined by the surfaces 59*a* and 59*b* on mounting means 46 and segment 58, respectively. The distance between surfaces 59*a* and 59*b*, forming access opening 60*a*, is only slightly larger than the diameter of mooring line 24, thus allowing mooring line 24 to pass through. However, opening 60*a* is much smaller than the diameter of a bulge on line 24, thus preventing a bulge from passing through opening 60*a***.

The purpose of the smaller size of opening **60*a* is to further help prevent accidental withdrawal of an inserted bulge, bulge 64 by way of example, under those conditions when the boat is unattended and the line may be lying loosely on the deck of the boat, and a force normal to the mooring line may act to push bulge 64 toward and through opening 60. The smaller size of opening 60*a* vis-a-vis opening 60 helps prevent such accidental withdrawal of mooring line 24**.

A consequence of the smaller size of opening **60*a* is that the mooring line cannot be dropped down into slot 54, with a bulge simply guided into opening 60 as in cleat 22, but a portion of the line 24 near inserted bulge, bulge 64 by way of example, first must be bent under arc 42 of cleat 22*a* in order to insert line 24 into slot 54. That is, the portion of line 24 adjacent to bulge 64, and on the side of bulge 64 closest to the slip-loop must be bent under. That bent portion of mooring line 24 is fed into opening 60*a* and then guided into slot 54 and drawn away from opening 60*a***.

Figure 7:
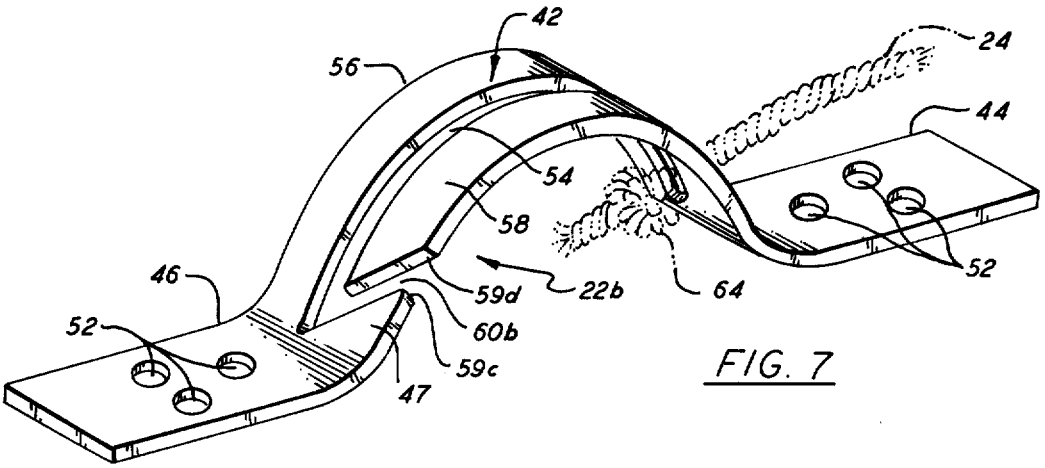
FIG. 7 is a perspective view of yet another embodiment of the cleat portion of the boat mooring apparatus of FIG. 1; it shows an opening in the slot which is slightly larger than the mooring line means diameter but smaller than the diameter of a bulge and, in addition, the opening is so positioned as to further help prevent accidental withdrawal of the mooring line means proximal end portion.
Figure 8:
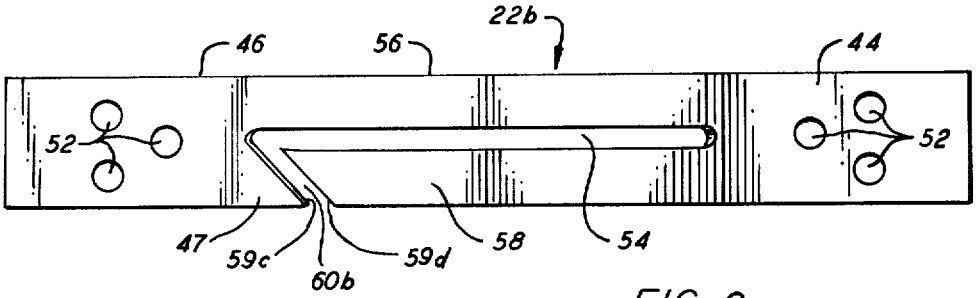
FIG. 8 is a plan view of the cleat illustrated in FIG. 7.

Referring now to FIGS. 7 and 8, another alternative embodiment of the cleat **22*a* of the present invention is shown. This embodiment is given reference numeral 22*b*. Its purpose and operation is the same as cleat 22*a*, except that access opening 60*b* of cleat 22*b*, corresponding to access opening 60*a* of the cleat 22*a*, is longitudinally slanted upwardly from the deck 48 of the boat to which it may be attached. Opening 60*b* is defined by surfaces 59*c* and 59*d* on arm 47 extending from mounting means 46 and segment 58**, respectively.

The reason opening **60*b* is slanted upwardly is further to prevent accidental withdrawal of mooring line 24 from slot 54 when the boat is unattended and the mooring line 24 is lying loosely on the boat deck 48 and a force normal to the mooring line 24 may act to push the inserted bulge toward access opening 60*b*. In addition to the bulge being prevented from coming out of opening 60*b* because of the nearness of surfaces 59*c* and 59*d*, an accidental uplifting force on line 24 is required, not merely a sideways force as in cleat 22*a*, to cause line 24 accidentally to come out of slot 54**, a very unlikely event.

The insertion procedure of line 24 into slot 54 of cleat **22*b* is substantially the same as with cleat 22*a***.

Figure 9:
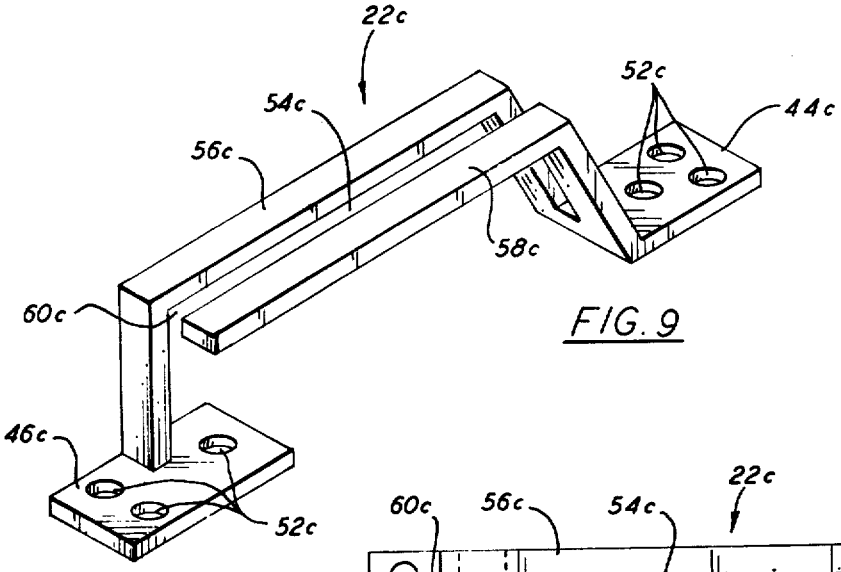
FIG. 9 is a perspective view of a further embodiment of the cleat portion of the boat mooring apparatus of FIG. 1; it has straight parallel members rather than arcuate parallel members.
Figure 10:
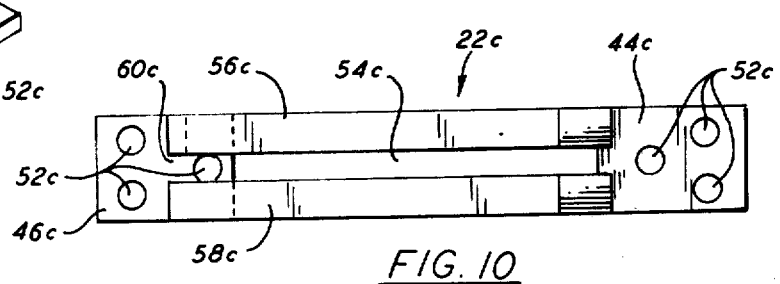
FIG. 10 is a plan view of the cleat illustrated in FIG. 9.

Similarly, FIGS. 9 and 10 show yet another alternative embodiment of cleat 22 of the present invention, which is given reference numeral **22*c*. Cleat 22*c* differs from cleat 22 only in the shape of the parallel segments. Parallel segments 56*c* and 58*c* of cleat 22*c* are formed with straight sections. The access opening 60*c* defined by segment 58*c* and mounting means 46*c* also may be arranged to allow only the line 24 to pass through without allowing a bulge to pass through and therefore function the same way as cleats 22*a* or 22*b***.

Figure 11:
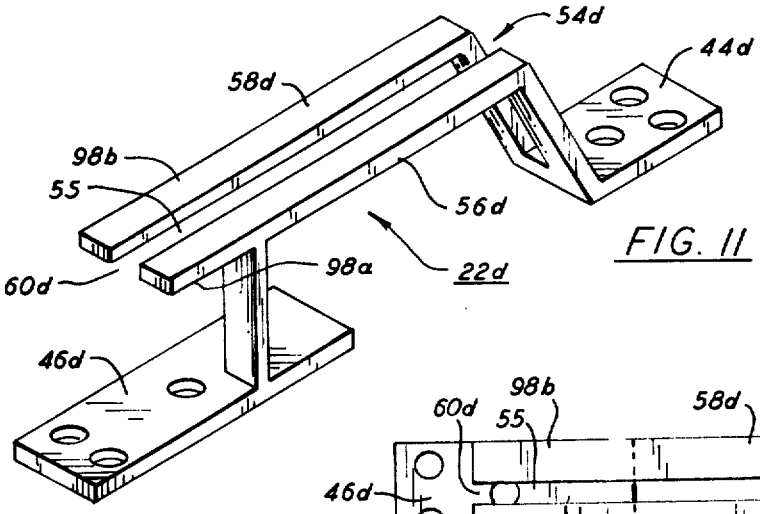
FIG. 11 is a perspective view of still a further embodiment of the cleat portion of the boat mooring apparatus of FIG. 1; it has straight parallel members rather then arcuate parallel members and, in addition, has the parallel members extending rearwardly of the inverted U-shaped member.
Figure 12:
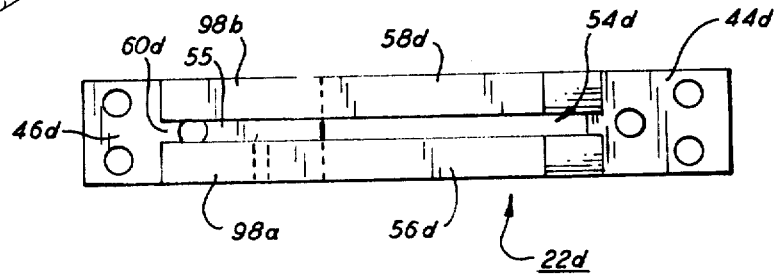
FIG. 12 is a plan view of the cleat illustrated in FIG. 11.
Figure 13:
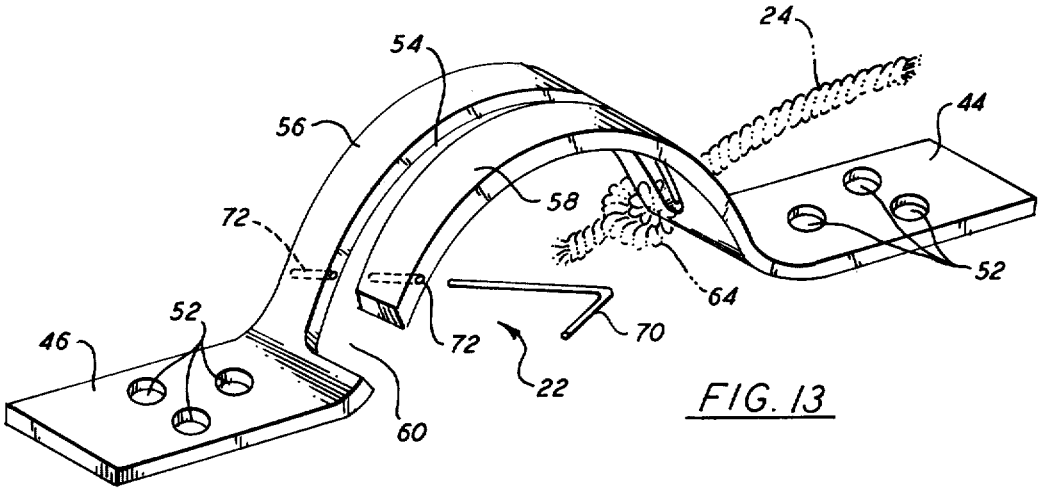
FIG. 13 is a perspective view, similar to FIG. 3, of an alternative embodiment showing a removable pin means.
Figure 14:
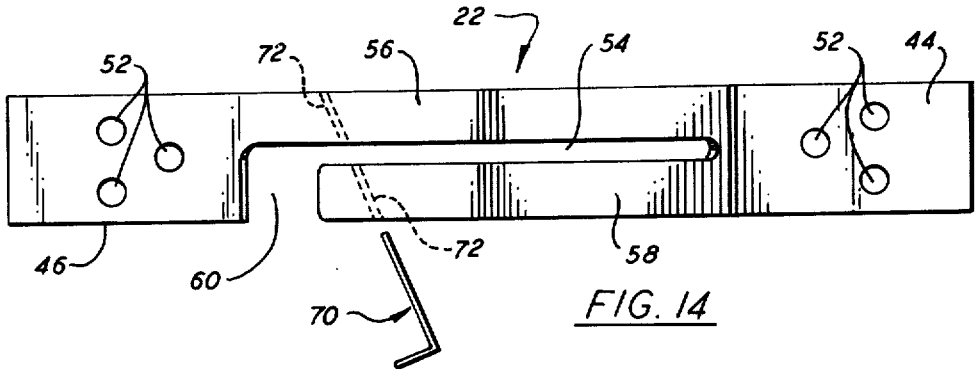
FIG. 14 is a plan view of the cleat illustrated in FIG. 13.
Figure 15:
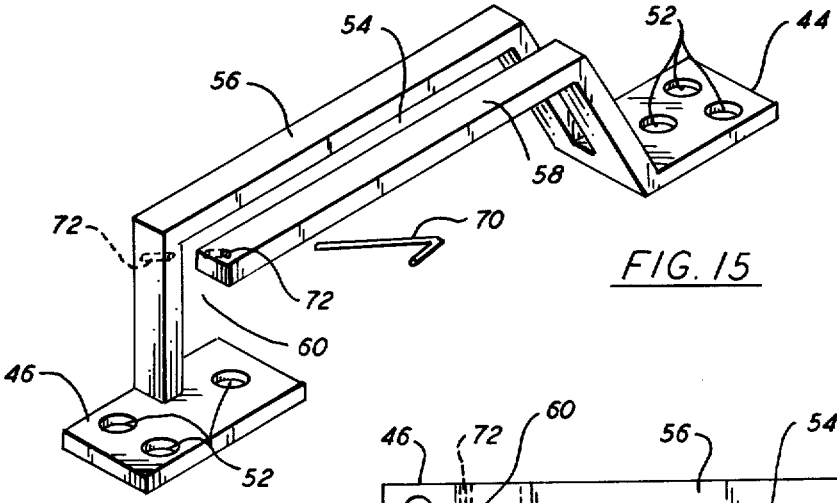
FIG. 15 is a perspective view, similar to FIG. 11, of another alternative embodiment showing a removable pin means.
Figure 16:
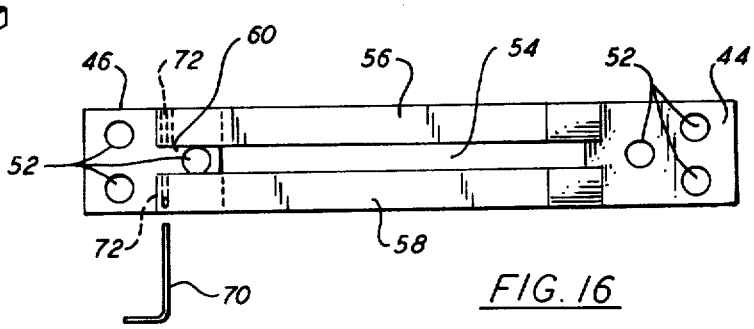
FIG. 16 is a plan view of the cleat illustrated in FIG. 15.
Figure 17:
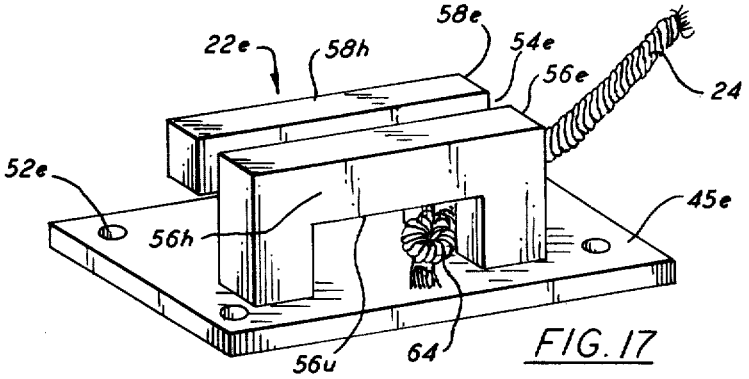
FIG. 17 is a perspective view of yet a further embodiment of the cleat.
Figure 18:
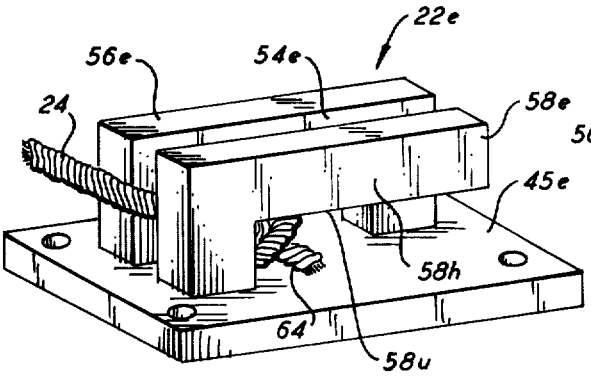
FIG. 18 is a perspective view of the cleat shown in FIG. 17 but from the opposite side.
Figure 19:
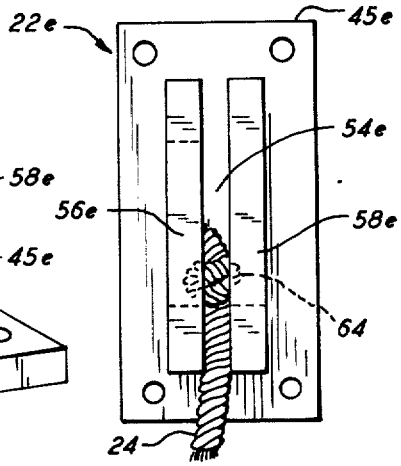
FIG. 19 is a plan view of the cleat shown in FIGS. 17 and 18.
Figure 20:
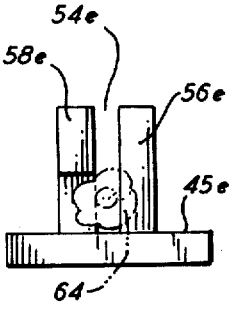
FIG. 20 is an end view of the cleat shown in FIGS. 17 and 18.

Referring now to FIGS. 11 and 12, yet a different alternative embodiment of cleat 22 of the present invention is shown. This embodiment is given reference numeral **22*d*. Similarly to cleat 22, in cleat 22*d* slot 54*d* is defined by segments 56*d* and 58*d*. Cleat 22*d* differs from all the other cleats shown in that parallel arms 98*a* and 98*b* extend rearwardly behind and as extensions of segments 56*d* and 58*d*, respectively, and form a slot 55. Slot 55 is substantially the same width as slot 54*d*. Although arms 98*a* and 98*b* are shown on a cleat with straight parallel members like 22*c***, such parallel arms may be employed on a cleat with arcuate members.

The purpose of the additional parallel arms **98*a* and 98*b* is further to prevent accidental withdrawal of the selected inserted bulge, for example bulge 64 from the slot 54*d*, arms 98*a* and 98*b* requiring still a further directional movement of the inserted mooring line to get past the rearward portion of arched member 58*d* and into slot 55 in order to withdraw the mooring line 24 from the cleat 22*d*. Further restriction of movement may be accomplished when the distance between the mounting means 46*d* (or another support) and the extensions 98*a* and 98*b*** is the same or slightly larger than the diameter of an inserted bulge.

The balance of the construction and operation of the cleat **22*d* is identical with that previously described with reference to cleat 22** and will not be described in greater detail.

Referring now to FIGS. 17, 18, 19 and 20, yet a further alternative embodiment of cleat 22 of the present invention is shown. This embodiment is given reference numeral **22*e*. It differs from all the other cleats shown in that the undersurface portions 58*u* and 56*u* of the horizontal portions 58*h* and 56*h* of the parallel segments 58*e* and 56*e* are the same distance from the deck of the boat 48, to which the cleat 22*e* may be attached, or from the base 45*e* of the cleat 22*e*** as the diameter of a bulge.

The balance of the construction and operation of cleat **22*e* is preferably identical with that previously described with reference to cleat 22** and will not be described in greater detail.

Of course, as should be understood, the arrangements illustrated in FIG. 2 or FIG. 21 may be used with any cleat that has two prong members, or two upstanding members defining a slot.

The advantage of the inverted U-shaped slot arrangement, the essence of the present invention, of the cleats is not to only speed and simplify the mooring operation but to prevent accidental disengagement of a mooring line from the cleat during the occurrence of a condition of slackness in an inserted mooring line while the boat is unattended, or when the dock or mooring post is higher than the boat, while in the instance of just a pair of upstanding prongs the possibility of accidental withdrawal of an inserted mooring line is greater.

Various other modifications to the cleat may occur to one of ordinary skill in the art. The inverted U-shaped cleats illustrated have arcuate and straight parallel members defining a slot and have essentially a polygonal access opening. However, the cleats would function with an almost infinite variety of shapes of arches and access openings so long as the stop member portions are substantially parallel.

Therefore, the words "concave" and "convex" in the claims are not intended to restrict the members only to curved or arcuate members. Rather, the word "concave" should indicate that surface of the cleat, excluding the mounting means which would be seen if the boat deck as illustrated in FIG. 1 were transparent and one could look up through it to the cleat. Of course, "convex" means that surface of the cleat exluding the mounting means which would be seen by standing on the boat deck and looking straight down at the cleat. Further, the claims use the phrase "a plurality of longitudinally spaced apart bulges". It should be noted that actually only one cleat insertable bulge is required at any one time. As mentioned, the reason for more than one bulge is so that the boater can choose that bulge which provides the proper line length from cleat and boat, to dock and mooring post means. Once having chosen the one appropriate bulge, the others—for that particular mooring operation—become almost superfluous. Therefore, the phrase "a plurality of longitudinally spaced apart bulges" should be considered as meaning at least one or, one or more.

By using a boat mooring cleat apparatus, and a boat mooring line apparatus comprising a boat mooring apparatus, quick releasable mooring of a boat to a mooring post, with a minimum of effort and a maximum of security, will be accomplished.

What is claimed is:

1. A boat mooring apparatus for enabling quick releasable mooring of a boat to a mooring post means, said apparatus comprising:

(A) a mooring line means having an associated diameter and a plurality of longitudinally spaced apart bulges therealong, said bulges having transverse dimensions greater than said mooring line means diameter, means operatively associated with said mooring line means for forming an adjustable size slip-loop at the distal end of said mooring line means, said slip-loop being slippable over said mooring post means and adjustably tightenable thereabout to securely fasten said mooring line means to said mooring post means, and (B) boat mountable cleat means comprising a pair of substantially parallel spaced apart members comprising a convex and a concave side defining a slot for insertably receiving a portion of the proximal end of said mooring line means opposite from said distal end thereof, said slot being narrower in width than the transverse dimensions of any one of said bulges, said spaced apart members defining a stop member on the concave sides of said members for an adjacent one of said bulges of said inserted mooring line means proximal end portion for preventing removal of said inserted mooring line means proximal end portion from said cleat means by a force along said mooring line means while enabling both quick insertion of said mooring line means proximal end portion and quick intentional removal of said inserted mooring line means proximal end portion from said cleat means slot by a sufficient force substantially normal to said mooring line means, one pair of ends of said spaced apart members being in transverse registration, means to interconnect said one pair of ends and to mount said interconnected pair of ends on a support, said spaced apart members being configured to extend away from the support adjacent to said one pair of ends and thereafter to extend along and spaced from said support, a single one of said members being inverted U-shaped and configured to extend to an end at the support, the other of said spaced apart members terminating short of said end of said one member to provide an access opening spaced away from the longitudinal center of said inverted U-shaped member for insertion of a bulge along said proximal end portion of said mooring line means, mounting means adjacent to said end of said one member closest to said access opening adapted to be fastened to said support such that said access opening is positioned further away from said mooring post means than said transversely registered ends, so that a tensile force acting on the mooring line means from the mooring post means draws the inserted bulge away from the access opening, said slot enabling a predetermined slippage of said inserted mooring line means within said slot dependent upon the longitudinal extent between the transversely registered ends and said access opening.

2. A boat mooring apparatus in accordance with claim 1 wherein said slot is substantially equal in width to said mooring line means diameter.

3. A boat mooring cleat apparatus in accordance with claim 1 wherein said spaced apart members comprise arcuate members defining an arcuate channel comprising said slot.

4. A boat mooring cleat apparatus in accordance with claim 1 wherein at least one portion of said spaced apart members comprise straight sections, defining a straight channel comprising said slot.

5. A boat mooring cleat apparatus in accordance with claim 1 wherein said access opening is spaced away from said end of said inverted U-shaped member.

6. A boat mooring cleat apparatus in accordance with claim 1 wherein the span between the parallel members and the support is slightly larger than the transverse dimensions of said bulges.

7. A boat mooring cleat apparatus in accordance with claim 1 wherein said access opening is slightly larger than the transverse dimensions of said bulges.

8. A boat mooring cleat apparatus in accordance with claim 1 wherein said access opening is smaller than the transverse dimensions of said bulges but larger than the associated diameter of said mooring line means.

9. A boat mooring cleat apparatus in accordance with claim 1 wherein the access opening is oriented to lie obliquely to said inverted U-shaped member.

10. A boat mooring cleat apparatus in accordance with claim 1 wherein both of the spaced apart members have extensions that are parallel to each other and that project to free ends beyond said end of said inverted U-shaped member, said extensions defining a slot which is substantially the same width as the spaced apart members.

11. A boat mooring apparatus in accordance with claim 1 wherein said cleat means further comprises a removable pin means associated with said slot removably insertable adjacent said inserted bulge of said mooring line means for preventing accidental withdrawal of said inserted mooring line means proximal end portion from said slot.

12. A boat mooring apparatus in accordance with claim 11 wherein said removable pin means is so oriented as to be retained adjacent said inserted bulge of said mooring line means by gravity.

13. A boat mooring apparatus in accordance with claim 1 wherein said bulges comprise knots in said mooring line.

14. A boat mooring apparatus in accordance with claim 1 wherein said mooring line means includes resilient means for providing an additional bearing force for said adjacent bulge of said inserted mooring line means proximal end portion against said stop member in response to said mooring line means being pulled taut.

15. A boat mooring cleat apparatus for enabling quick releasable mooring of a boat to a mooring post means by a mooring line means having an associated diameter and a plurality of longitudinally spaced apart bulges therealong, said bulges having transverse dimensions greater than said mooring line means diameter, said cleat apparatus comprising a pair of substantially parallel spaced apart members comprising a convex and a concave side defining a slot for insertably receiving a portion of the proximal end of said mooring line means, said slot being narrower in width than the transverse dimensions of any one of said bulges, said spaced apart members defining a stop member on the concave sides of said members for an adjacent one of said bulges of said inserted mooring line means proximal end portion for preventing removal of said inserted mooring line means proximal end portion from said cleat apparatus by a force along said mooring line means while enabling both quick insertion of said mooring line means proximal end portion and quick intentional removal of said inserted mooring line means proximal end portion from said slot by a sufficient force substantially normal to said mooring line means, one pair of ends of said spaced apart members being in transverse registration, means to interconnect said one pair of ends and to mount said interconnected pair of ends on a support, said spaced apart members being configured to extend away from the support adjacent to said pair of ends and thereafter to extend along and spaced from said support, a single one of said members being inverted U-shaped and configured to extend to an end at the support, the other of said spaced apart members terminating short of said end of said one member to provide an access opening spaced away from the longitudinal center of said inverted U-shaped member for insertion of a bulge along said mooring line means, mounting means adjacent to said end of said one member closest to said access opening adapted to be fastened to said support such that said access opening is positioned further away from said mooring post means than said transversely registered ends, so that a tensile force acting on the mooring line means from the mooring post means draws the inserted bulge away from the access opening, said slot enabling a predetermined slippage of said inserted mooring line means within said slot dependent upon the longitudinal extent between the transversely registered ends and said access opening.

16. A boat mooring cleat apparatus in accordance with claim 15 wherein said slot is substantially equal in width to said mooring line means diameter.

17. A boat mooring cleat apparatus in accordance with claim 15 wherein said spaced apart members comprise arcuate members defining an arcuate channel comprising said slot.

18. A boat mooring cleat apparatus in accordance with claim 15 wherein at least one portion of said spaced apart members comprise straight sections, defining a straight channel comprising said slot.

19. A boat mooring cleat apparatus in accordance with claim 15 wherein said access opening is spaced away from said end of said inverted U-shaped member.

20. A boat mooring cleat apparatus in accordance with claim 15 wherein the span between the parallel members and the support is slightly larger than the transverse dimensions of said bulges.

21. A boat mooring cleat apparatus in accordance with claim 15 wherein said access opening is slightly larger than the transverse dimensions of said bulges.

22. A boat mooring cleat apparatus in accordance with claim 15 wherein said access opening is smaller than the transverse dimensions of said bulges but larger than the associated diameter of said mooring line means.

23. A boat mooring cleat apparatus in accordance with claim 15 wherein said access opening is oriented to lie obliquely to said inverted U-shaped member.

24. A boat mooring cleat apparatus in accordance with claim 15 wherein both of the spaced apart members have extensions that are parallel to each other and that project to free ends beyond said end of said inverted U-shaped member, said extensions defining a slot which is substantially the same width as the spaced apart members.

25. A boat mooring cleat apparatus in accordance with claim 15 further comprising a removable pin means associated with said slot and removably insertable behind said inserted bulge of said inserted mooring line means for preventing accidental withdrawal of said inserted mooring line means proximal end portion from said slot.

26. A boat mooring cleat apparatus in accordance with claim 25 wherein said removable pin means is so oriented as to be retained by gravity.

27. A boat mooring line apparatus for enabling quick releasable mooring of a boat to a mooring post means by means of a boat mountable cleat means comprising a pair of substantially parallel spaced apart members comprising a convex and a concave side defining a slot for insertably receiving a portion of the proximal end of said mooring line, said slot having an associated width, said mooring line apparatus comprising a mooring line having an associated diameter and a plurality of longitudinally spaced apart bulges therealong, said bulges having transverse dimensions greater than both said mooring line diameter and said slot width, means operatively associated with said mooring line for forming an adjustable size slip-loop at the distal end of said mooring opposite from said slot insertable mooring line proximal end, said slip-loop being slippable over said mooring post means and adjustably tightenable thereabout to securely fasten said mooring line to said mooring post means, an adjacent one of said bulges of said inserted mooring line proximal end portion being stoppable against the concave sides of said spaced apart members for preventing removal of said inserted mooring line proximal end portion from said cleat means by a force along said mooring line while enabling both quick insertion of said mooring line proximal end portion and quick intentional removal of said inserted mooring line proximal end portion from said cleat means slot by a sufficient force substantially normal to said mooring line, one pair of ends of said members being in transverse registration, means to interconnect said one pair of ends and to mount said interconnected pair of ends on a support said member being configured to extend away from the support adjacent to said one pair of ends and thereafter to extend along and spaced from said support, a single one of said members being inverted U-shaped and configured to extend back to the support, the other of said spaced apart members terminating short of said end of said one member to provide an access opening spaced away from the longitudinal center of said one member, for insertion of a bulge said proximal end portion of said mooring line, mounting means adjacent to said end closest to said access opening intended to be fastened to said support such that said access opening is positioned further away from said mooring post means than said transversely registered ends, so that a tensile force acting on the mooring line apparatus from the mooring post means draws the inserted bulge away from the access opening, said slot enabling a predetermined slippage of said inserted mooring line within said slot dependent upon the longitudinal extent between the transversely ends and said access opening.

28. A boat mooring cleat apparatus in accordance with claim 27 wherein said access opening is spaced away from said end of said inverted U-shaped member.

29. A boat mooring line apparatus in accordance with claim 27 wherein said bulges comprise knots in said mooring line.

30. A boat mooring line apparatus in accordance with claim 27 further comprising a supplemental resilient means for providing an additional bearing force for said adjacent bulge of said inserted mooring line apparatus proximal end portion against said stop member in response to said mooring line apparatus being pulled taut.

* * * * *